US006757941B2

(12) United States Patent
Feliz

(10) Patent No.: US 6,757,941 B2
(45) Date of Patent: Jul. 6, 2004

(54) DECORATIVE GATE HANDLE PULLING DEVICES

(76) Inventor: Merry L. Feliz, Feliz Design, 4775 Ajay Cr., Santa Maria, CA (US) 93455

( * ) Notice: Subject to any disclaimer, the term of this patent is extended or adjusted under 35 U.S.C. 154(b) by 0 days.

(21) Appl. No.: 10/281,098

(22) Filed: Oct. 28, 2002

(65) Prior Publication Data

US 2004/0078934 A1 Apr. 29, 2004

(51) Int. Cl.[7] ..... E05C 3/08; A45C 13/28

(52) U.S. Cl. ..... 16/442; 16/428; 16/444; 292/336.3; 292/DIG. 30; 49/279; 49/354

(58) Field of Search ..... 16/441, 442, 444, 16/446; 428/11; 49/279, 354; 292/DIG. 29, DIG. 30, 237, 235, 50, 53, 84, 86, 125, 127, 336.3, 133; 116/148, 172, 81, 75, 86, 122.6; D03/331; 248/200, 218.1, 222.11, 328; 256/65, 13, 73

(56) References Cited

U.S. PATENT DOCUMENTS

| | | | | | |
|---|---|---|---|---|---|
| 168,971 | A | * | 10/1875 | Cook et al. | 116/67 R |
| 176,910 | A | * | 5/1876 | Whitcomb | 116/172 |
| 391,881 | A | * | 10/1888 | Caudle | 116/16 |
| 443,013 | A | | 12/1890 | Smith | |
| 943,387 | A | * | 12/1909 | Cannon | 49/299 |
| 1,153,847 | A | * | 9/1915 | Huffman | 49/282 |
| 1,232,609 | A | * | 7/1917 | Rowe | 256/73 |
| 1,235,560 | A | | 8/1917 | Deloatch | |
| 1,326,283 | A | * | 12/1919 | Nagayama | 116/86 |
| 1,633,361 | A | * | 6/1927 | Bryant | 116/81 |
| 1,805,984 | A | | 5/1931 | Hull | |
| 1,874,881 | A | * | 8/1932 | Brown | 105/354 |
| 2,812,442 | A | | 11/1957 | De Mun | |
| 2,965,892 | A | * | 12/1960 | Langdon | 340/393.3 |
| 3,266,831 | A | * | 8/1966 | Banse | 292/133 |
| 3,433,449 | A | | 3/1969 | Musante | |
| 3,433,518 | A | | 3/1969 | Foltz | |
| D218,877 | S | | 10/1970 | Clayton | |
| 3,599,274 | A | | 8/1971 | Donovan | |
| 3,800,687 | A | * | 4/1974 | Nozawa | 454/357 |
| 4,405,099 | A | * | 9/1983 | Bolen | 244/1 R |
| D304,671 | S | | 11/1989 | Reaney | |
| 4,993,759 | A | | 2/1991 | Thomas | |
| 5,078,438 | A | | 1/1992 | Bieganski | |
| 5,123,223 | A | | 6/1992 | Makarevich et al. | |
| 5,358,292 | A | * | 10/1994 | Van Wiebe et al. | 292/235 |
| 5,416,951 | A | | 5/1995 | Keyaki et al. | |
| 5,498,041 | A | * | 3/1996 | Bezzerides et al. | 292/225 |
| 5,517,787 | A | | 5/1996 | Mack | |
| 5,655,801 | A | * | 8/1997 | Casey | 292/210 |
| 5,836,021 | A | | 11/1998 | Davidson et al. | |
| 5,888,117 | A | | 3/1999 | Sutton | |
| 5,934,123 | A | | 8/1999 | Eldredge | |
| 6,079,855 | A | | 6/2000 | Azeredo et al. | |
| 6,170,892 | B1 | * | 1/2001 | Lantiegne | 292/235 |
| 6,296,220 | B1 | | 10/2001 | Texidor | |
| 6,315,431 | B1 | | 11/2001 | Greedy | |
| 6,394,511 | B1 | * | 5/2002 | Lam et al. | 292/336.3 |

* cited by examiner

*Primary Examiner*—Anthony Knight
*Assistant Examiner*—Andre' L. Jackson
(74) *Attorney, Agent, or Firm*—Richard C. Litman

(57) ABSTRACT

An assortment of decorative gate handle pulling devices which include a right-angled bracket attached to a gate post, a string or cable having one end attached to a gate latch and which extends out the horizontal arm of the bracket, the opposite end of the string being suspended from the end of the horizontal arm and having a decorative gate pull attached thereto. The gate is opened by grasping the decorative pull and pulling on the string to unlatch the gate.

10 Claims, 10 Drawing Sheets

DECORATIVE GATE HANDLE PULLING DEVICES

BACKGROUND OF THE INVENTION

1. Field of the Invention

The present invention relates to decorative pulling devices. More specifically, the invention is an assortment of decorative design pieces for attachment to a garden gate opener as gate opener pulling devices.

2. Description of the Related Art

The relative art of interest describes various gate opening devices, but none discloses the present invention. Commonly a string having one end tied to the gate latch and a ring tied to its opposite end is used as a gate pull. Examples of such gate pulls are shown in U.S. Pat. No. 1,235,560, issued Aug. 7, 1917 to K. H. Deloatch; U.S. Pat. No. 3,433,518, issued Mar. 18, 1969 to R. E. Foltz; U.S. Pat. No. 4,993,759, issued Feb. 19, 1991 to P. C. Thomas; and U.S. Pat. No. 5,078,438, issued Jan. 7, 1992 to C. Bieganski. While functional, such a device is not aesthetically pleasing and the ring may be difficult for young children, the elderly, and the handicapped to grasp securely. In addition, the string has a tendency to become entangled in the gate mechanism, or to fray by friction against the gate post. There is a need for a gate opening device which may be grasped securely and which is suitable for use by any person, including a young or an old person. Therefore, the gate handle pulling devices of the present invention are designed to enable a better grasp than prior gate pulls, and which are decorative to be unique in the neighborhood. The related art of interest is discussed in the order of perceived relevance to the present invention.

U.S. Design Pat. No. 304,671 issued on Nov. 21, 1989, to Robert W. Reaney shows an ornamental combined gate latch pull and cable comprising an ornamental oval shaped handle having a large ball with a smaller ball on opposite sides thereof attached by a ring to a short cable and another ring. The ornamental gate latch pull device is distinguishable for requiring a distinctive oval handle and attachment rings.

U.S. Pat. No. 1,805,984 issued on May 19, to Franklyn H. Hull describes a combined door bumper and coat hanger comprising a J-shaped strap having a garment hook at its bottom, a resilient bent-in hook and a rubber button on its short arm, and its long arm is attached to a door by two screws. The device is distinguishable for its hook configuration.

U.S. Pat. No. 6,079,855 issued on Jul. 27, 2000, to Ruth Ann Azeredo et al. describes a detachable decorative system for lamp shades comprising a plurality of clips or hooks of different shapes hung on either the top or the bottom edge and in-between edges of a lamp shade and connected to various decorative pieces such as bead chains suspending decorative pieces. The detachable decorative systems are distinguishable for requiring a plurality of clips or hooks.

U.S. Pat. No. 5,517,787 issued on May 21, 1996, to Edward Mack describes a removable entranceway puzzle gate to block a driveway or doorway comprising two crossmembers that attach to either side of the opening, and a linking member that connects the inner ends of the crossmembers together, forming a continuous barrier across the opening. Decorative panels such as trees and logos are bolted to the crossmembers. The removable gate is distinguishable for being functionally and structurally distinctive.

U.S. Pat. No. 5,416,951 issued on May 23, 1995, to Keiichi Keyaki et al. describes a decorative pull tab adapted for being pivotally attached to a slide fastener body and for fastening a decorative piece thereto. The pull tab comprises a ring pivotally connected to the slider body and a pull tab body including a pair of first and second clamping plates and a hinge joint joining the first and second plates. The pull tabs are folded over on the hinge joint. The ring is pivotally connected to the hinge joint with the decorative piece clamped between the first and second plate. The decorative pull tab is distinguishable for being limited to attachment to a slide fastener body.

U.S. Design Pat. No. 218,877 issued on Oct. 6, 1970, to La Verne E. Clayton shows an ornamental pull device comprising an oval handle attached pivotally to a bracket by a pin and having a knurled portion opposite the bracketed end. The ornamental pull device is distinguishable for its distinctive shape and structure.

U.S. Pat. No. 443,013 issued on Dec. 16, 1890, to Friend W. Smith describes a pendent handle comprising a rubber sphere with a pair of metal caps connected to a chain by an eye and a screw-nut element. The pendent handle is distinguishable for requiring a rubber sphere as a handle.

U.S. Pat. No. 2,812,442 issued on Nov. 5, 1957, to Frederick S. De Mun describes an electric light socket chain pull device comprising an ornament such as a planar potted plant or dog attached to the chain. The device is distinguishable for requiring its attachment only to a light fixture chain.

U.S. Pat. No. 6,315,431 B1 issued on Nov. 13, 2001, to Christopher Greedy describes a pull chain light assembly that attaches to a pull chain for the lamp portion of a ceiling fan. The end of the pull chain has a lithium battery operated light emitting diode and a light sensitive switch in a bell housing. The assembly is distinguishable for being limited to a pull chain of a ceiling fan.

U.S. Pat. No. 3,433,449 issued on Mar. 18, 1969, to Thomas J. Musante describes a decorative supporting hook assembly comprising a hook member of a strip material having a hook on one end and a fold near the opposite end, a decorative cover piece or medallion for rigidity overlaying the hook member while exposing the hook, and the cover piece having a tapered cavity for frictionally receiving the fold of the strip. The decorative hook assembly is distinguishable for being limited to a hook assembly.

U.S. Pat. No. 3,599,274 issued on Aug. 17, 1971, to Marion Donovan describes an actuator means for a slide fastener or zipper comprising a flexible double cord of elastic extensible material provided at a distal end with a round weight and the proximate end tied to the slide of the zipper. The device is distinguishable for requiring a round weight and an elastic cord.

U.S. Pat. No. 5,123,223 issued on Jun. 23, 1992, to Justine D. Makarevich et al. describes a decorative attachment device for a door comprising a sheet covering for a door having linear elements or pockets for holding the sheet to the door. The sheet can have visual elements, such as objects or scenes, and a hook for supporting a wreath. The device is distinguishable for requiring attachment to a face of a door.

U.S. Pat. No. 5,836,021 issued on Nov. 17, 1998, to Gary L. Davidson et al. describes a novelty toilet pull chain and tank valve actuator. The flexible chain has an outside fob illustrated as a cowboy boot or a football. A long list of other fobs are listed. The device is distinguishable for being limited to a toilet pull chain end.

U.S. Pat. No. 5,888,117 issued on Mar. 30, 1999, to Renee Sutton describes a transparent display for a novelty item comprising a one-piece, water-filled display in a molded plastic base placed on the stomach and on the back of a stuffed bear. The display is distinguishable for requiring a water-filled base.

U.S. Pat. No. 5,934,123 issued on Aug. 10, 1999, to Eleanore C. Eldredge describes an easy access key chain comprising a single connector, multiple key chains and key rings having keys and ornaments. The device is distinguishable for requiring multiple key chains and key rings.

U.S. Pat. No. 6,296,220 B1 issued on Oct. 2, 2001, to Genaro Texidor describes a millennium novelty that embodies the nature of a "millennium", i.e., to have the simultaneous ability to look forwards to a new era and backwards to the past, by having two eyes looking in different directions. The novelty is attached to desk accessories, jewelry, key holders, belt buckles, clothing, dolls, and figurines. The novelty is distinguishable for being limited to display on various items but not for use as a gate pull.

None of the above inventions and patents, taken either singly or in combination, is seen to describe the instant invention as claimed. Thus, a decorative gate pull solving the aforementioned problems is desired.

SUMMARY OF THE INVENTION

The decorative gate handle pulling devices are various ornamental gate pulls which are attached by a string or cable to a gate latch for opening the latch. Typically a fence gate will have a latch which includes a keeper attached to a fixed gate post and a rotating or sliding element attached to the gate which engages the keeper. The latch mechanism is normally located on the inside of the fence, i.e., the side facing the residence. The latch will have a rotating or sliding mechanism that can be operated by reaching over the fence to open the latch. In order to avoid reaching over the fence, a string is attached to the lever and the string is stretched over the fence or through a bore in the fence so that when the string is pulled, the mechanism is unlatched to open the gate.

The present mechanism provides for various pulls which are attached to the end of the string and provide for a large, ergonomically shaped, but decorative pull that can be easily grasped by young children, the elderly, and the handicapped, as well as by the normal user. In addition, the gate handle pulling device of the present invention may include a bracket adapted for attachment to the gate post, which serves as a standoff so that the string does not become entangled in the gate mechanism, and does not fray or wear due to friction from repetitive movement against the gate post.

An assortment of decorative devices can be hung from the bracket based on various themes such as nautical, lunar, star, insect, romance, etc. The specific themes provided are a flower, sea anchor, scrolls, boat steering wheel, crescent moon with a star, a coconut palm tree, a dragonfly, and heart pendants. These devices would be utilitarian as well as decorative to enhance one's garden gate. Small children can easily reach up and pull down the attached device.

Accordingly, it is a principal object of the invention to provide an attachment device to a conventional pull-up garden gate opener apparatus to open the gate from an opposite side of the fence.

It is another object of the invention to provide a decorative bracket for supporting the pulling device.

It is a further object of the invention to provide a pulling cord passing through the decorative bracket for attachment to ornamental handle pieces.

Still another object of the invention is to provide a series of decorative attachment devices based on various themes.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to an assortment of gate pulls for opening a fence gate having a conventional gate latch. There is a problem for small children, handicapped individuals, or aged people who are unable to reach over a fence in order to open up a conventional fence gate latch. Therefore, the present invention provides a gate pull which can be operated from the side of the fence opposite the gate latch to open the gate.

Figure 1:
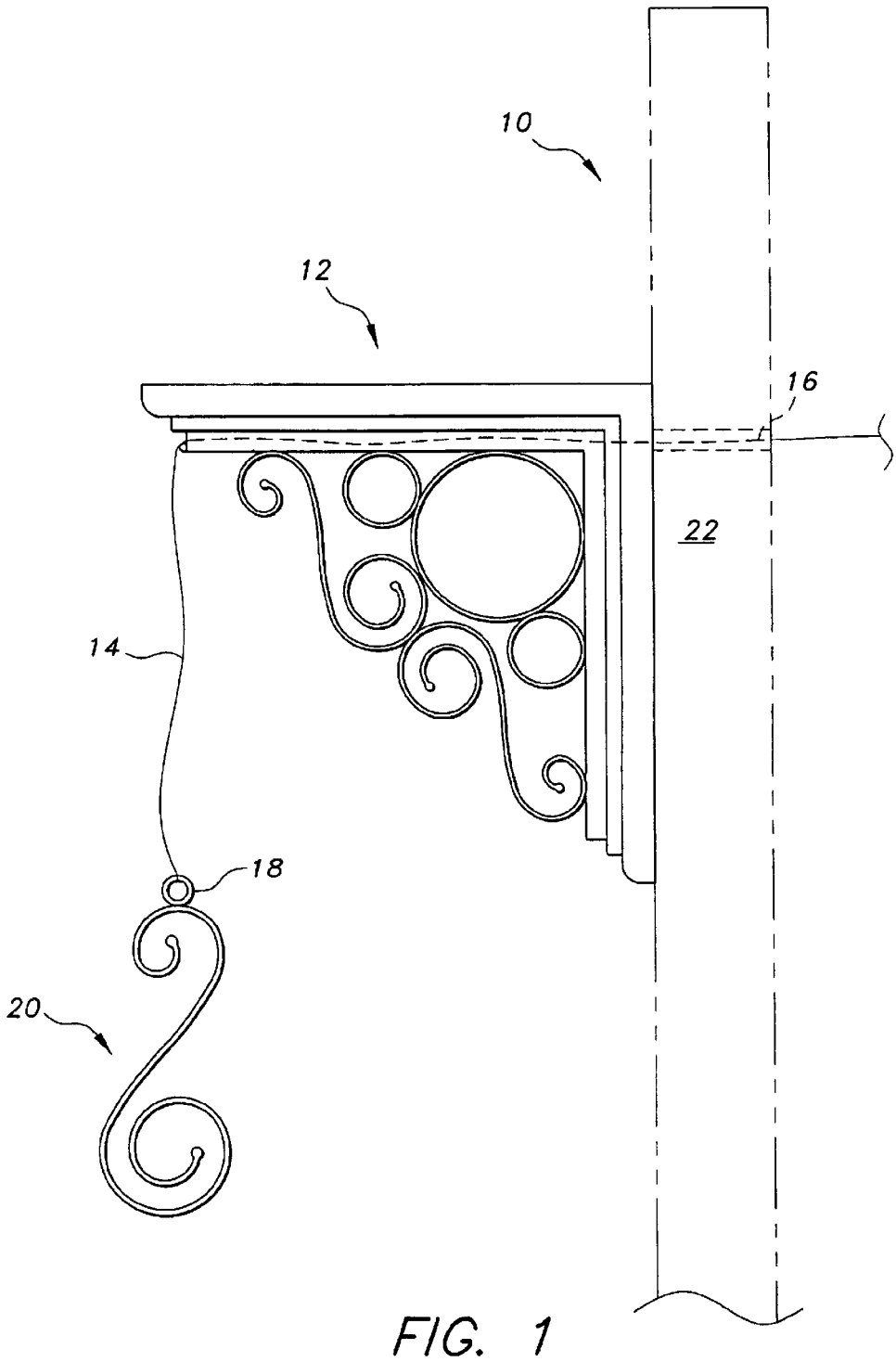
FIG. 1 is an environmental, side view of a decorative garden gate pull open device and bracket attached to a fence post (in shadow) according to the present invention.
Figure 2:
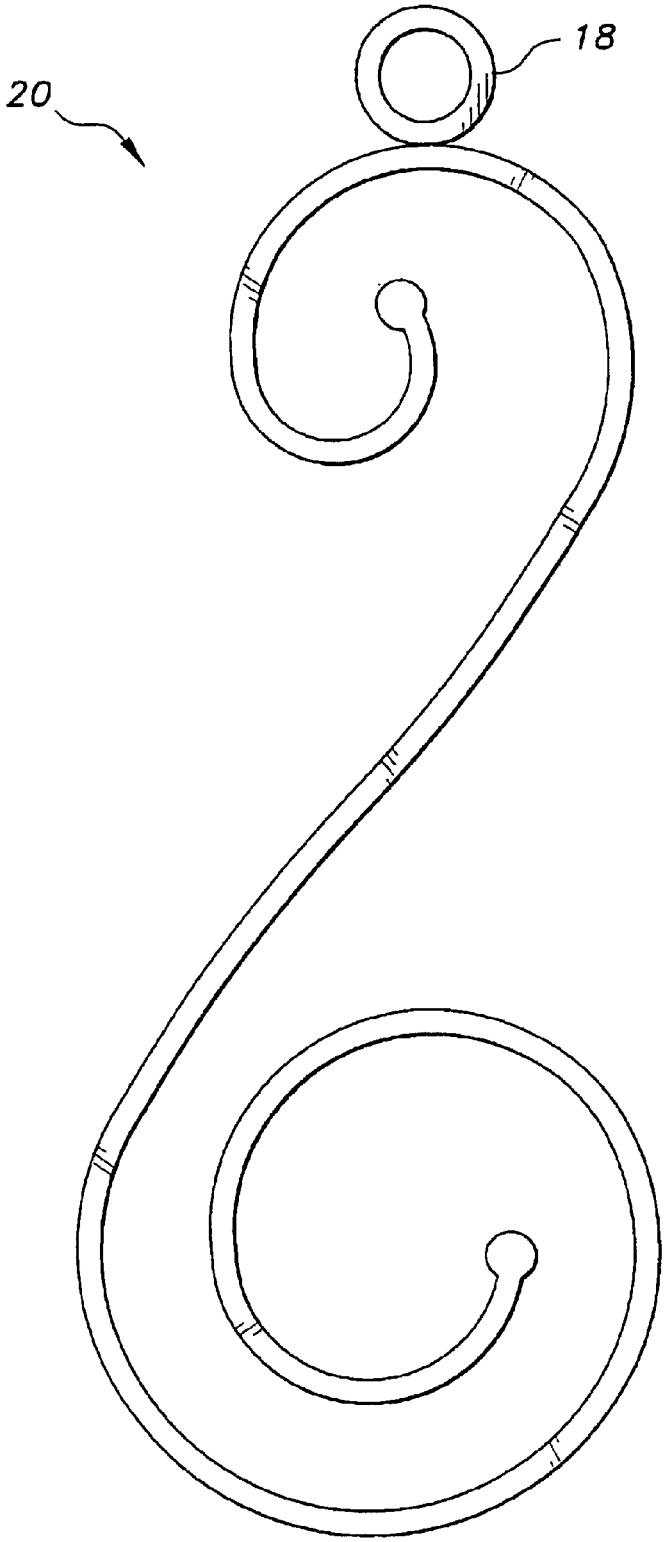
FIG. 2 is an elevational front view of a first embodiment of a decorative garden gate pull open device based on a wrought iron scroll design according to the present invention.

FIG. 1 illustrates an example of a fence 10 in shadow having a right-angled metal bracket 12 according to the present invention supporting a string or cable 14 adapted for attachment to the gate latch (not shown), the string 14 passing through a bore 16 defined in the fence post 22 and being supported by the horizontal arm of the bracket 12, being suspended from the end of the horizontal arm to attach to the connecting ring 18 of a first decorative scrolled metal pull handle 20 shaped as an "S", shown in more detail in FIG. 2. The metal bracket 12 is essential to provide a spaced sturdy support or standoff for the exposed portion of the cable 14 leading to the pull handle 20.

Figure 3:
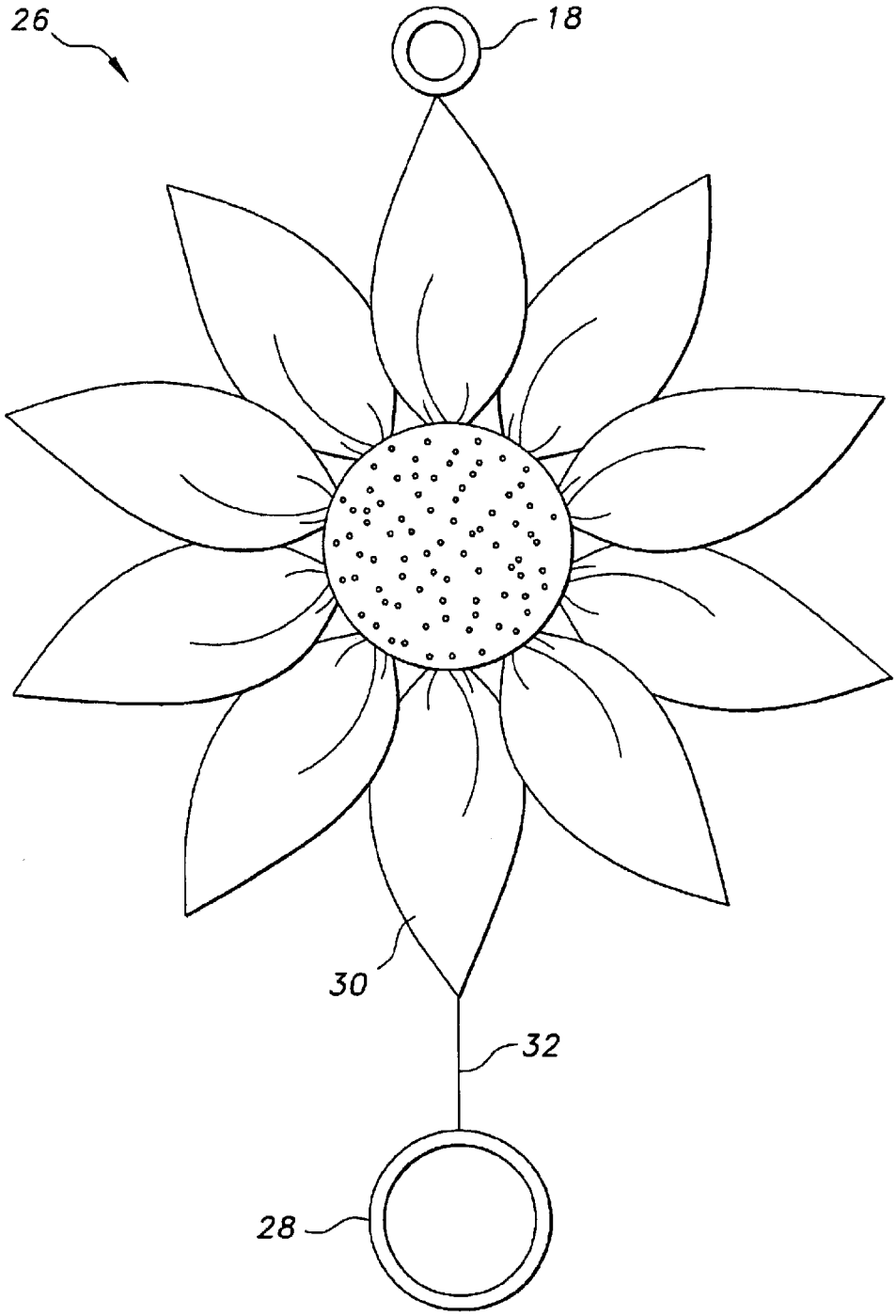
FIG. 3 is an elevational front view of a second embodiment of a decorative garden gate pull open device based on a flower design according to the present invention.

FIG. 3 depicts a second embodiment of a pull formed as a metal flower 26 having the connecting ring 18 on top and a small ring 28 attached to a bottom petal 30 by a short length of cable 32.

Figure 4:
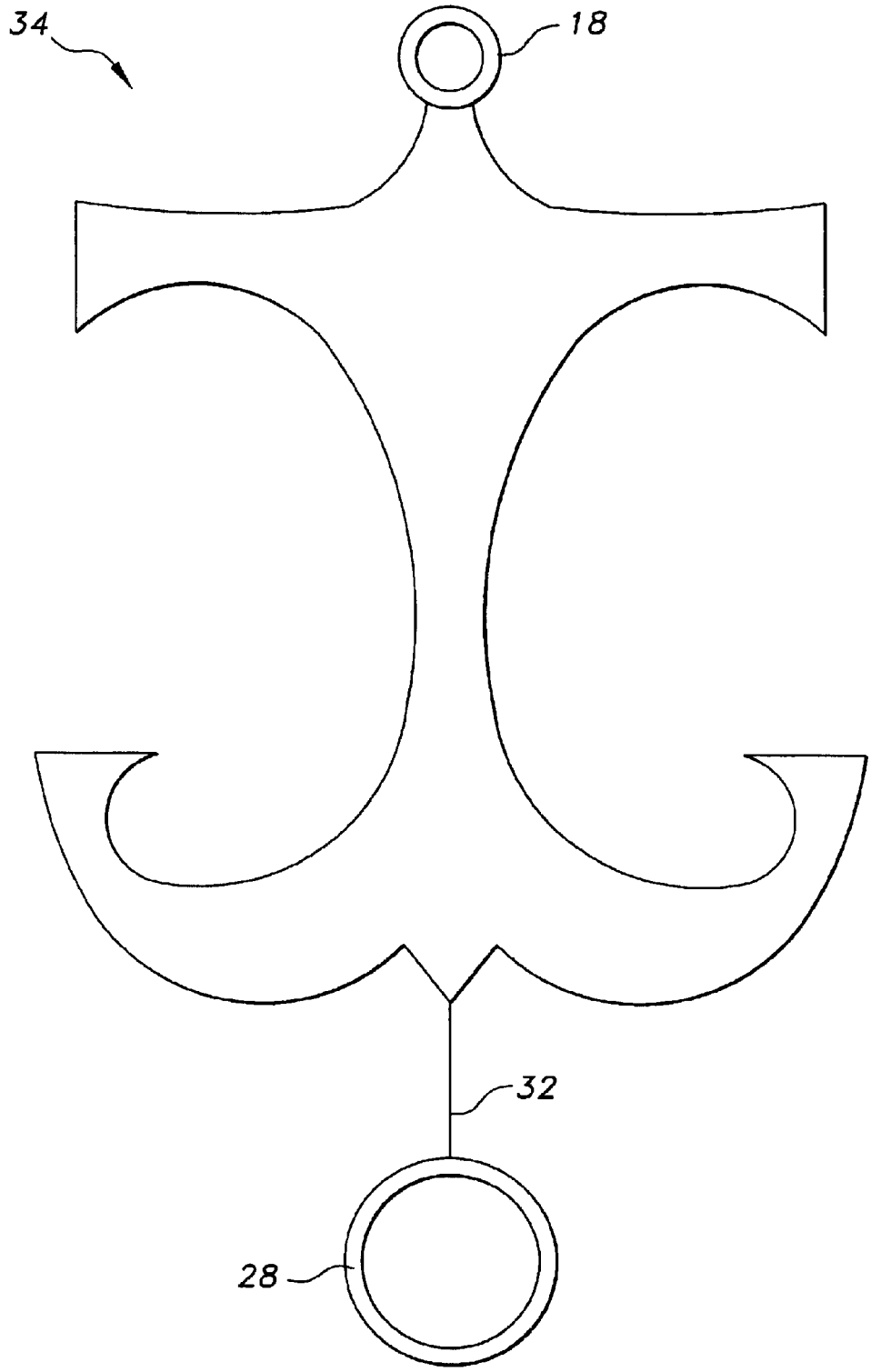
FIG. 4 is an elevational front view of a third embodiment of a decorative garden gate pull open device based on an anchor design according to the present invention.

FIG. 4 shows a third embodiment of a pull formed as a stylized sea anchor 34 with its top connecting ring 18 and having a small pull ring 28 attached from its bottom portion by a short length of cable 32.

Figure 5:
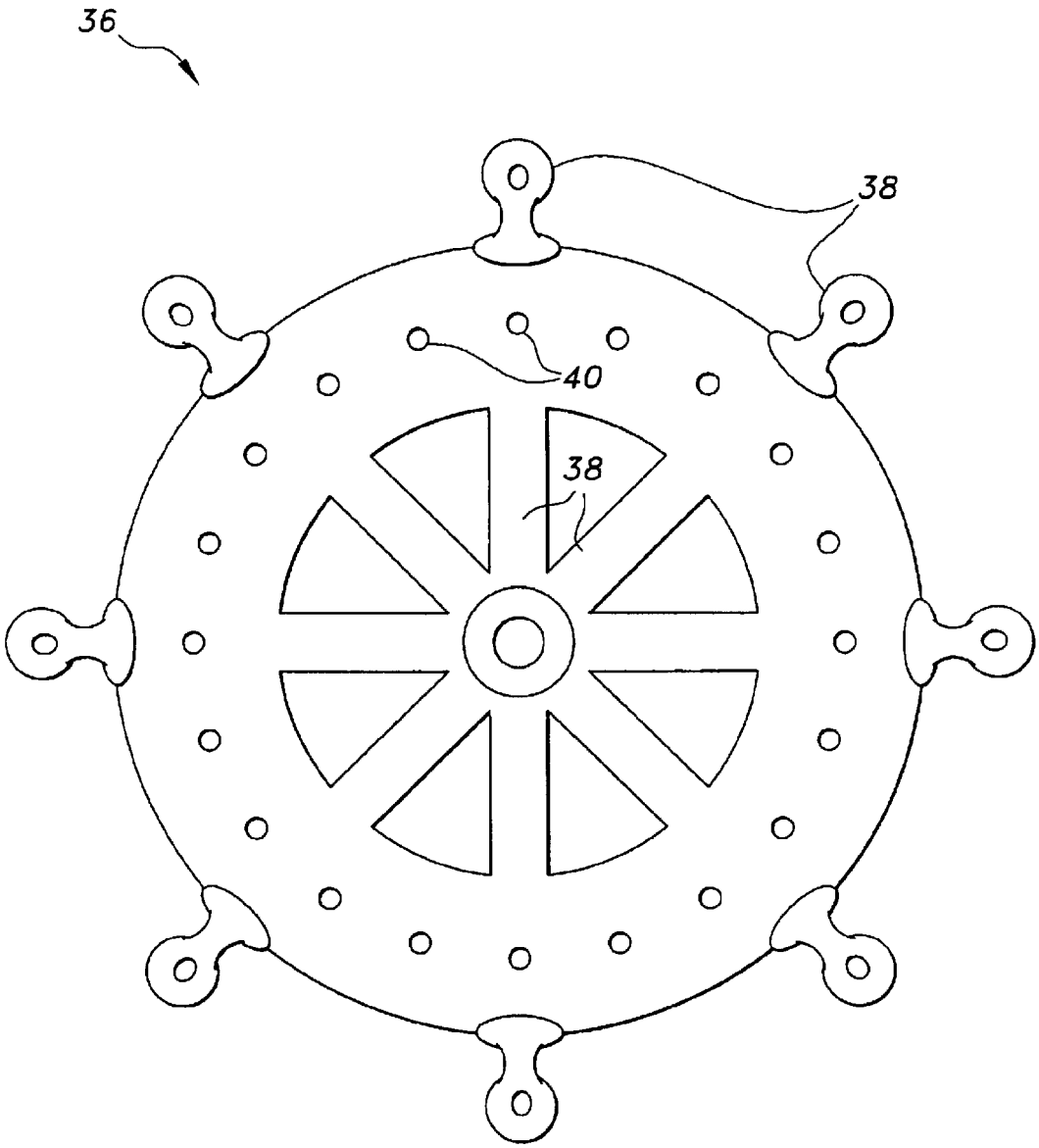
FIG. 5 is an elevational front view of a fourth embodiment of a decorative garden gate pull open device based on a boat steering wheel according to the present invention.

FIG. 5 illustrates a fourth embodiment of a pull formed as a stylized ship steering wheel 36 having a plurality of peripheral handle knobs 38 extending outward from the wheel 36 with its plurality of spokes 38 and apertures 40.

Figure 6:
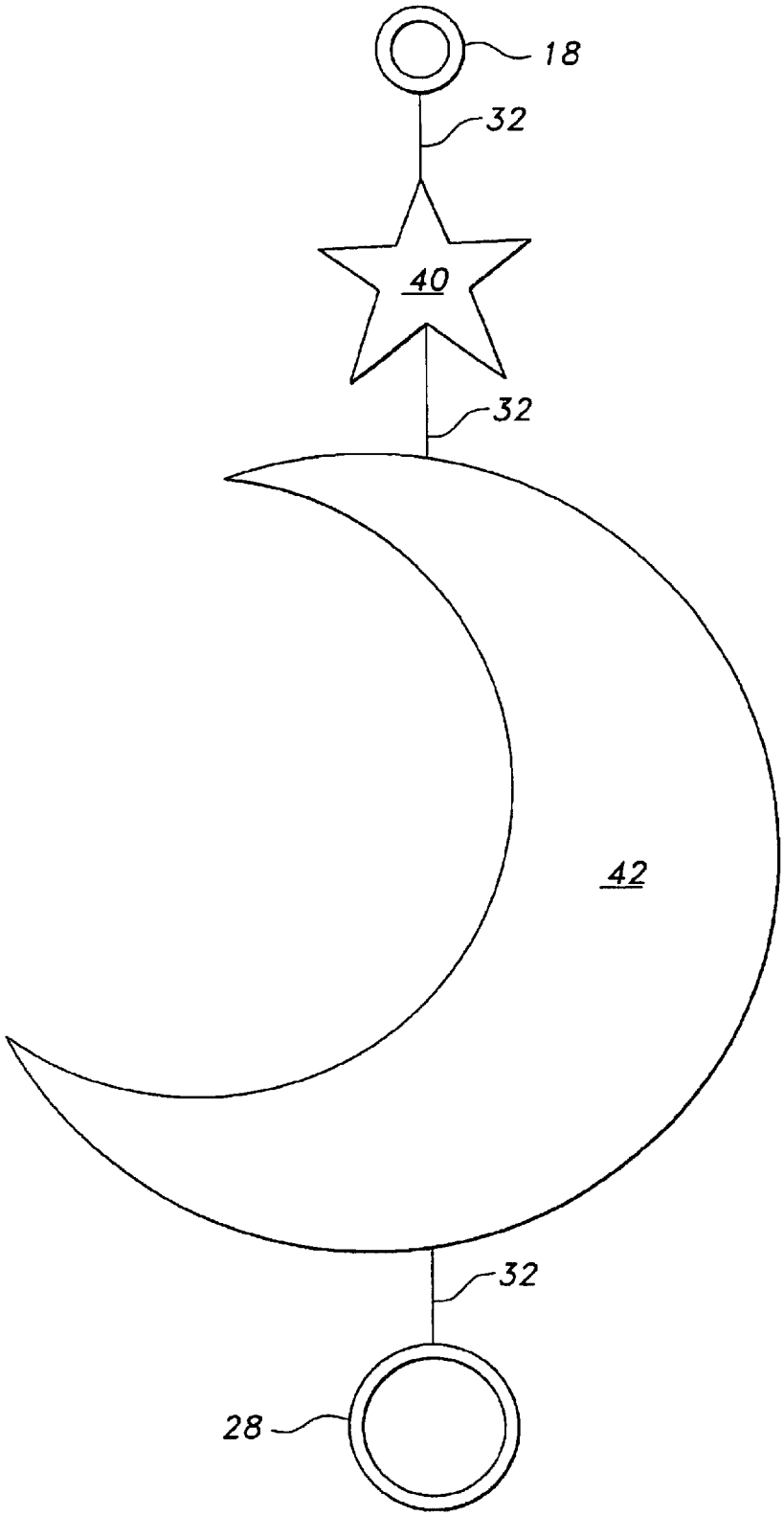
FIG. 6 is an elevational front view of a fifth embodiment of a decorative garden gate pull open device based on a crescent moon and star design according to the present invention.

FIG. 6 depicts a fifth embodiment of a pull formed as an astronomical configuration with a star 40 suspended from the connecting ring 18 and tied to a proportionately large crescent moon 42 by short cables 32. The small pull ring 28 is attached by another short cable 32 to the moon 42.

Figure 7:
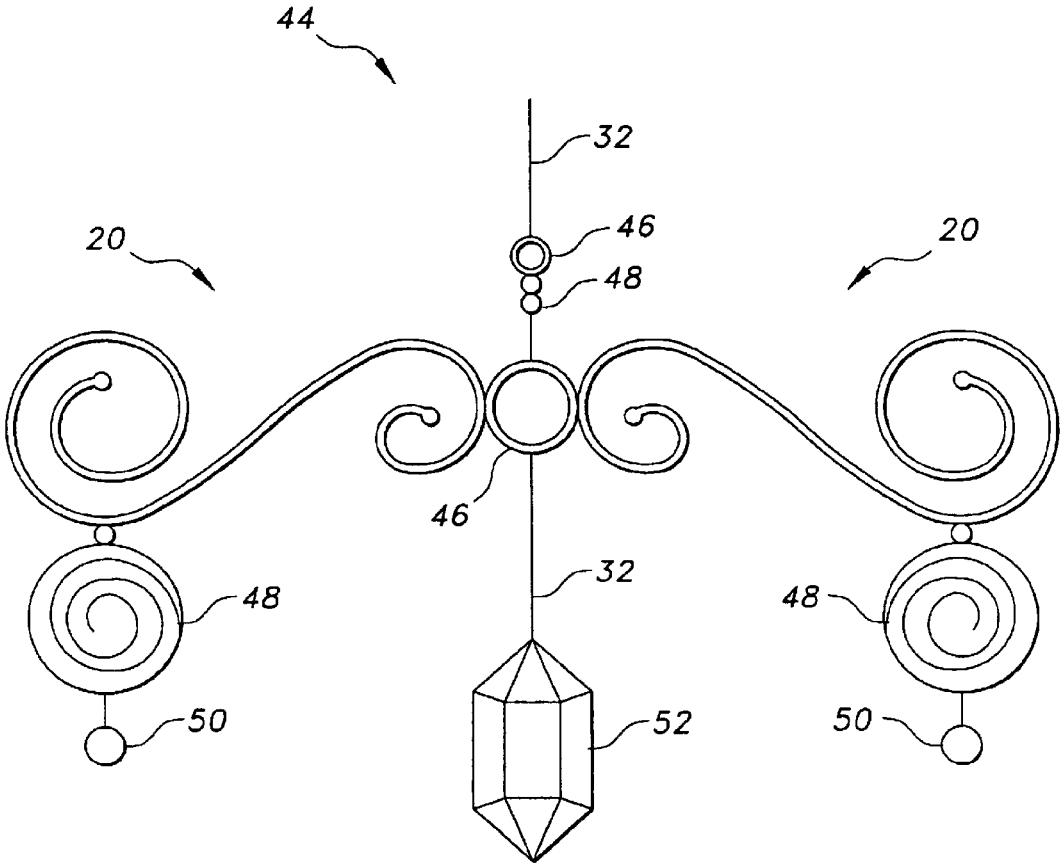
FIG. 7 is an elevational front view of a sixth embodiment of a decorative garden gate pull open device based on a scrolled design with three pendants according to the present invention.

FIG. 7 shows a sixth embodiment of a pull formed as an ornate metal gate pull 44 suspended by a small ring 46 with beads 48 on a short cable 32. The gate pull 44 has two symmetrical "S" shaped sides 20 of FIG. 2 attached to a medium-sized center ring 46. Each "S" shaped side 20 has a medallion 48 and a bead 50 suspended proximate its outer ends. A faceted jewel 52 is suspended from the center ring 46.

Figure 8:
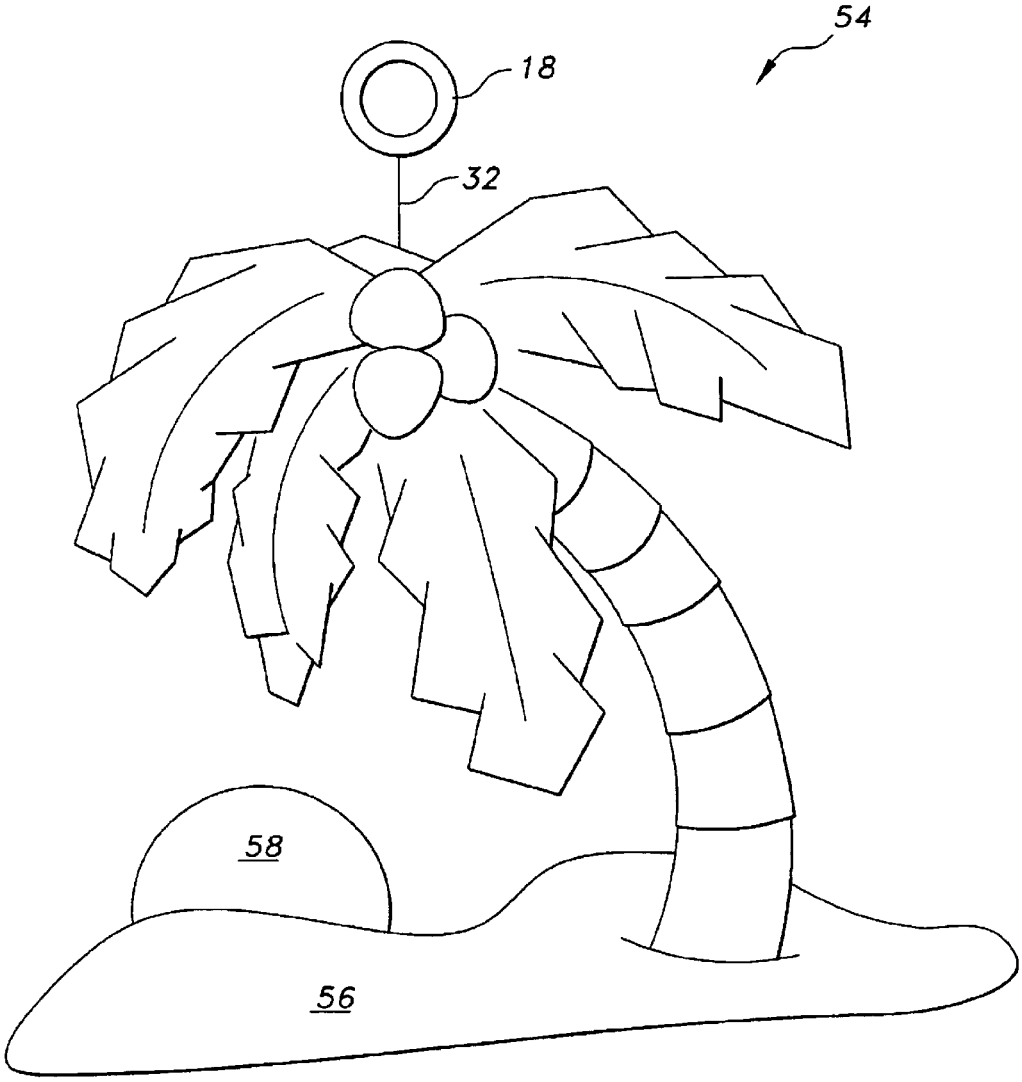
FIG. 8 is an elevational front view of a seventh embodiment of a decorative garden gate pull open device based on a coconut palm tree and rising sun design according to the present invention.

FIG. 8 shows a seventh embodiment of a pull formed as a tropical scene with a coconut palm tree 54 on land 56 with a rising sun 58 suspended by a short cable 32 attached to a connecting ring 18.

Figure 9:
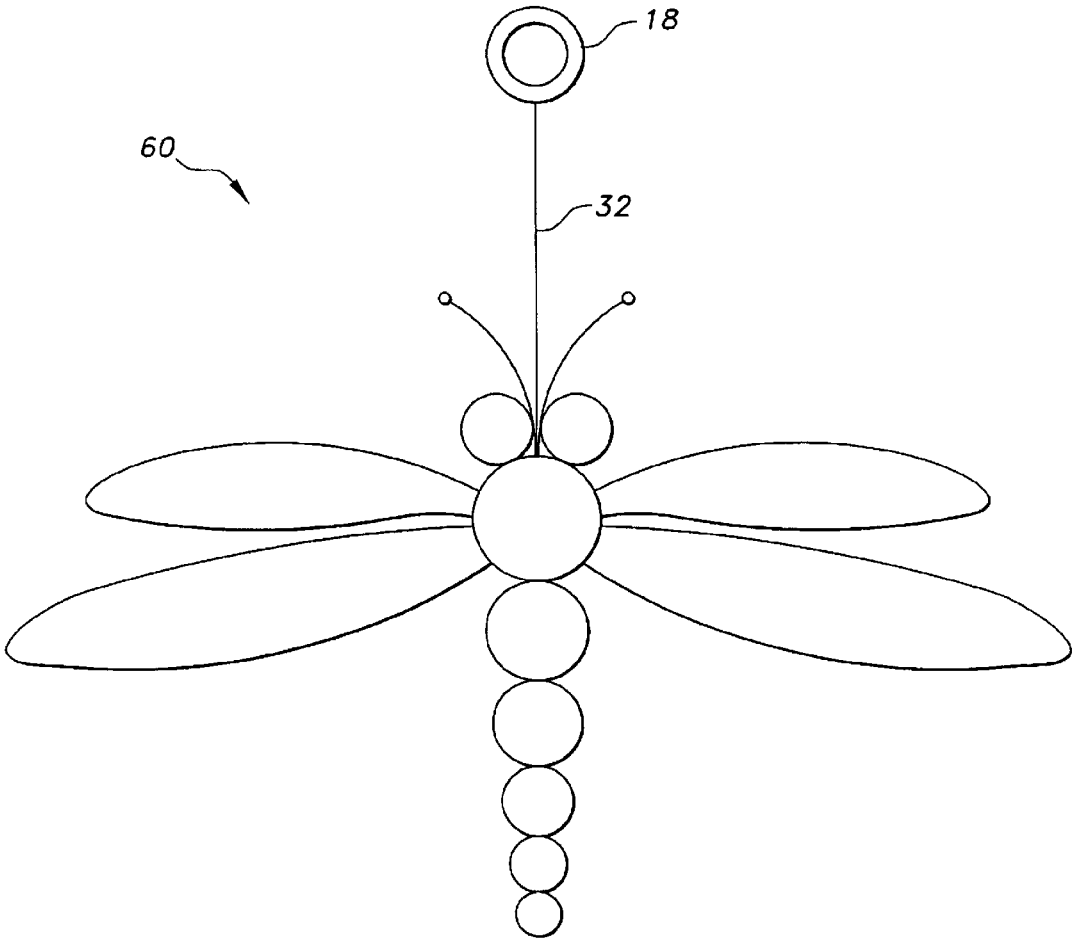
FIG. 9 is a front elevational view of an eighth embodiment of a decorative garden gate pull open device based on a dragonfly design according to the present invention.

FIG. 9 shows eighth embodiment of a pull formed as a dragonfly 60 suspended by a short cable 32 to the connecting ring 18. Other insects such as butterflies and the like can be used.

Figure 10:
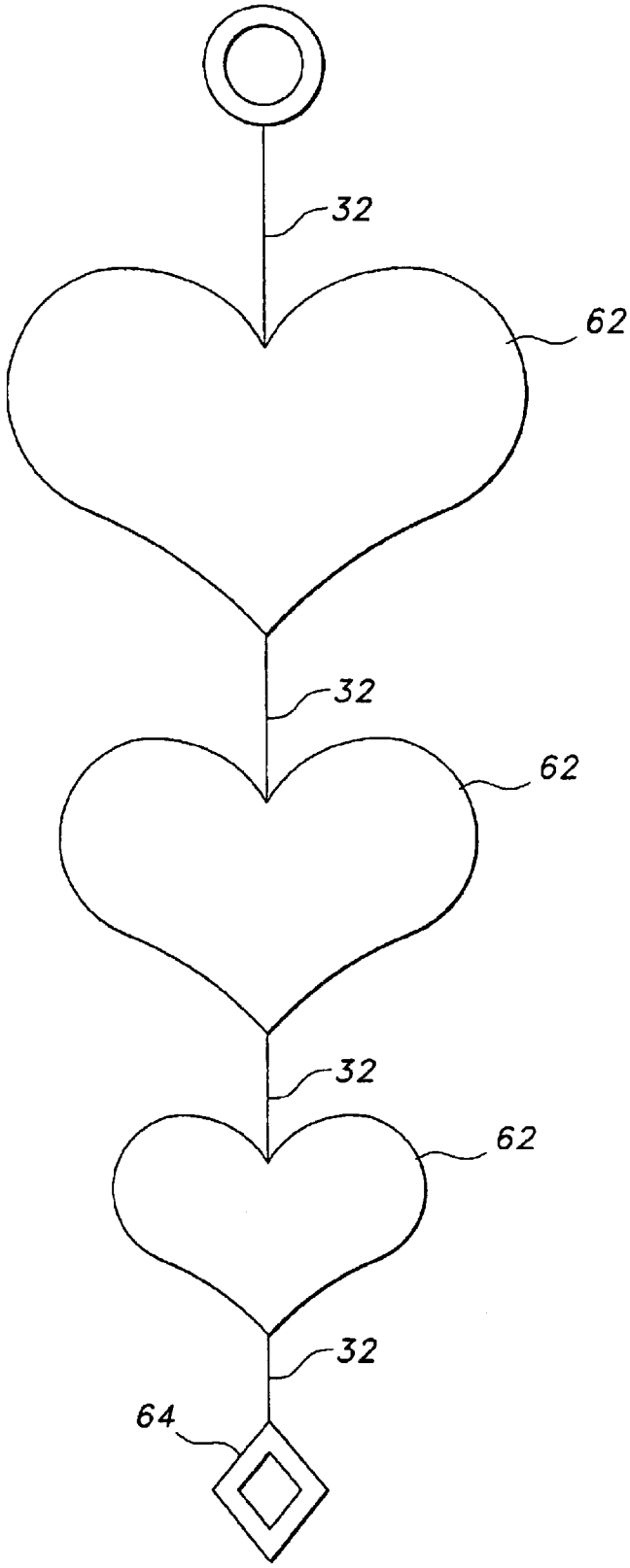
FIG. 10 is a front elevational view of a ninth embodiment of a decorative garden gate pull open device based on a string of hearts design according to the present invention.

FIG. 10 shows a ninth embodiment of a pull formed as a string of hearts 62 strung by short cables 32 from the connecting ring 18 and ending with a diamond shaped body 64 as seen in playing cards.

Thus, this assortment of decorative gate pulls provides the home owner with a selection for various occasions and moods for a plurality of gates.

It is to be understood that the present invention is not limited to the embodiments described above, but encompasses any and all embodiments within the scope of the following claims.

What is claimed is:

1. A decorative gate handle pulling device, comprising:

a right-angled bracket adapted for attachment to a gate post, the bracket having a vertical arm attached to the gate post on a side of the post opposite a gate latch, and having a horizontal arm extending outward and away from the gate post, the horizontal arm having a distal end opposite the gate post;

a flexible element having a first end adapted for attachment to the gate latch, the flexible element extending along the horizontal arm of said bracket and supported thereby, a portion of the flexible element being suspended from the distal end of the horizontal arm and terminating in a second end; and a decorative gate pull having a body formed in a decorative shape, the pull being attached to the second end of said flexible element;

wherein the gate latch is opened by grasping said decorative gate pull and pulling the flexible element.

2. The decorative gate handle pulling device according to claim 1, wherein said decorative gate pull is an S-shaped body.

3. The decorative gate handle pulling device according to claim 1, wherein said decorative gate pull comprises a metal body formed as a flower having a small metal ring suspended below it by a short length of cable.

4. The decorative gate handle pulling device according to claim 1, wherein said decorative gate pull is a metal body formed as a replica of a sea anchor having a small metal ring suspended below it by a short length of cable.

5. The decorative gate handle pulling device according to claim 1, wherein said decorative gate pull is formed as a stylized ship steering wheel having a plurality of peripheral handle knobs extending outward and a plurality of spokes and apertures.

6. The decorative gate handle pulling device according to claim 1, wherein said decorative gate pull is formed as a star suspended from a connecting ring and tied to a crescent moon and a pull ring.

7. The decorative gate handle pulling device according to claim 1, wherein said decorative gate pull is formed as a pair of symmetrical S-shaped metal scrolls connected by a centered metal ring and having a medal lion and a bead suspended from each said metal scroll, and a metal faceted jewel suspended from said centered metal ring.

8. The decorative gate handle pulling device according to claim 1, wherein said decorative gate pull is formed as a coconut palm tree on land with a rising sun.

9. The decorative gate handle pulling device according to claim 1, wherein said decorative gate pull is formed as a dragonfly connected by its nose.

10. The decorative gate handle pulling device according to claim 1, wherein said decorative gate pull is a string of hearts diminishing in size and ending in a diamond shaped body.

* * * * *